US005970616A

United States Patent [19]

Wahl et al.

[11] Patent Number: 5,970,616

[45] Date of Patent: Oct. 26, 1999

[54] HAIR TRIMMER WITH LIGHTED ROTATING HEAD

[75] Inventors: Gregory Wahl; Andrew Elston, both of Sterling, Ill.

[73] Assignee: Wahl Clipper Corporation, Sterling, Ill.

[21] Appl. No.: 08/995,815

[22] Filed: Dec. 22, 1997

[51] Int. Cl.[6] ..... B26B 19/06

[52] U.S. Cl. ..... 30/216; 30/199

[58] Field of Search ..... 30/216, 199, 527, 30/45

[56] References Cited

U.S. PATENT DOCUMENTS

| | | | |
|---|---|---|---|
| 1,680,289 | 8/1928 | Graeff | 30/216 |
| 1,997,096 | 4/1935 | Andis | 30/199 |
| 2,595,287 | 5/1952 | Perry | 30/45 |
| 3,604,915 | 9/1971 | Wahl | 30/216 |
| 3,800,172 | 3/1974 | Artin et al. | 310/50 |
| 4,581,822 | 4/1986 | Fujimura | 30/216 |
| 4,688,329 | 8/1987 | Oord | 30/527 |
| 4,926,553 | 5/1990 | Miskin et al. | 30/49 |
| 5,054,199 | 10/1991 | Ogawa et al. | 30/216 |
| 5,068,966 | 12/1991 | Wahl et al. | 30/43 |
| 5,165,172 | 11/1992 | Weinrauch | 30/199 |
| 5,325,590 | 7/1994 | Andis et al. | 30/216 |
| 5,372,420 | 12/1994 | Van Deursen et al. | 366/129 |
| 5,459,927 | 10/1995 | Kauer et al. | 30/43.1 |
| 5,582,476 | 12/1996 | Hansen | 362/115 |
| 5,606,799 | 3/1997 | Melton | 30/216 |

FOREIGN PATENT DOCUMENTS 4304703 8/1994 Germany .

OTHER PUBLICATIONS

Sharper Image Catalogue, "Turbo Groomer", p. 25.

*Primary Examiner*—Hwei-Siu Payer
*Attorney, Agent, or Firm*—Greer, Burns & Crain, Ltd.

[57] ABSTRACT

A hair trimmer that includes a main body extending between an upper end portion and a lower end portion and further includes a front side and a rear side. The main body defines a primary longitudinal axis that extends substantially linearly between the upper end portion and the lower end portion. A blade housing is rotatably attached to the upper end of the main body such that the blade housing is rotatable about the primary longitudinal axis with respect to said main body. The blade housing is defined by an attached side and a free side that is opposite to the attached side. An interface plane is defined between the main body and the blade housing. The interface plane extends at an interface angle that is oblique to the primary longitudinal axis. The present hair trimmer further includes a cutting mechanism that is removably seated upon the said free side of the blade housing. The cutting mechanism includes a cutting surface for engaging and severing hair. As an additional feature, the present hair trimmer may be also equipped with a light for illuminating the area about to be trimmed.

23 Claims, 5 Drawing Sheets

HAIR TRIMMER WITH LIGHTED ROTATING HEAD

The present invention relates generally to hair trimmers, and more particularly to hair trimmers configured for trimming beards and moustaches to obtain a neat and well-groomed appearance. Functionally, the present trimmer is designed to minimize arm strain resulting from use of the trimmer; to enable the user to have a relatively unobstructed view of the area being trimmed; and also to provide light to the area being trimmed. Structurally, the present hair trimmer includes: a rotating head that is configured to be rotated at an inclined angle with respect to the rest of the trimmer; a main body that extends generally linearly except for an offset portion near the upper end; and/or a light for illuminating the area being trimmed. While the majority of the following discussion relates to the trimming of beards and moustaches, it should be noted that many of the features of the present invention may also be applicable to other forms of trimmers or clippers, such as those used for cutting the hair upon the scalp, those used for shearing animals, those used for shaving a patient in preparation for surgery, etc.

BACKGROUND OF THE INVENTION

In order to obtain a neat and well-groomed appearance, a person wearing a beard and/or a moustache will normally wish to trim his facial hair occasionally. Presently, there are trimmers available which are combined with electric shavers, as well as stand alone electric beard/moustache trimmers. Commonly, these trimmers have a cutting head (in which one blade reciprocates against another) that is fixed in a single position and extends from the front of the unit. For cutting the hair to a uniform length, one may use an attachment comb that spaces the cutting head from the skin by a specified distance. Typically, it is suggested that the trimmers be used to cut the hair against the grain, i.e., opposite to the direction in which the hair naturally grows.

One problem with many currently available beard trimmers relates to the relationship between the cutting head and the handle (or main body) of the unit. Oftentimes the user must position his hand and arm in potentially uncomfortable or awkward positions in order to have the cutting head aligned in the desired position with the face and/or the neck. In addition to the potential discomfort, the positioning of the trimmer unit may place the body of the unit, the user's hand, or the user's arm (or possibly all three) directly in front of the area where the hair is being trimmed, all of which obstruct the user's view of the area being trimmed and make trimming more difficult. An unobstructed view is especially important when edging around the peripheries of the beard, moustache, and sideburns in order to create edge lines that are clean and crisp.

Another problem with many currently available trimmer units also relates to the user's lack of the ability to adequately see the area where the hair is being cut. Customarily, the light in a bathroom (where the majority of beard grooming most likely takes place) originates from an overhead light source. Once again, the user's hand and the trimmer unit can possibly hinder the user from obtaining an adequate view of the area being trimmed. In this instance, the trimmer unit and the user's hand may create shadows that prevent the area being trimmed from being adequately illuminated by the overhead light. This problem is magnified in the underchin area where the chin itself creates a shadow and reduces the visibility in this area.

Thus, in light of these problems, among others, a first object of the present invention is to provide an improved hair trimmer of a design that does not require the user to position his hand in a potentially uncomfortable or awkward manner.

A second object of the present invention is to provide an improved hair trimmer which is ergonomically designed to minimize potentially awkward hand positioning by including an offset portion near the top of the main body of the unit, which otherwise extends generally linearly to define a longitudinal axis.

Another object of the present invention is to provide an improved hair trimmer in which the user may select the alignment of the cutting surface so that his view of the area being trimmed is not obstructed by his hand or the trimmer body.

An additional object of the present invention is to provide an improved hair trimmer in which the cutting surface may be positioned at preselected orientations by rotating the blade housing with respect to the main body of the trimmer.

Another object of the present invention is to provide an improved hair trimmer with a rotatable blade housing that enables the user to place the cutting surface in a properly aligned position, while still being able to comfortably hold the main body of the trimmer.

An additional object of the present invention is to provide an improved hair trimmer that can be comfortably held by the user with his elbow in a relaxed position near his body while edging around the beard, moustache, and sideburns. The present invention is intended to permit the user to edge while the plane of the blades are held nearly perpendicular to the main longitudinal axis of the trimmer body, with this main longitudinal axis being positioned substantially vertically. In this manner, the user is holding the trimmer unit in a comfortable position with adequate visibility of the area being trimmed.

A related object of the present invention is to provide an improved hair trimmer that enables the user to hold the unit in a comfortable position while using the unit to cut the beard by stroking upwards under the chin and above the cheekbones, especially when the trimmer unit used without an attachment comb.

Still another object of the present invention is to provide an improved hair trimmer that is equipped with a light for illuminating the area where the hair is being trimmed.

An additional object of the present invention is to provide an improved hair trimmer that is equipped with both a light and a rotatable blade housing.

Yet another object of the present invention is to provide an improved hair trimmer in which the cutting surface is angled so that the user's hand and arm are placed in a more comfortable position when the trimmer is used to cut hair with the grain of hair growth. It has been found that a neater looking trimmed beard may be obtained by trimming the beard with the grain, contrary to the generally accepted practice of trimming the beard against the grain. While some conventional trimmers may be capable of trimming the hair with the grain, using a conventional trimmer for trimming with the grain generally results in some awkward hand and arm positioning because many conventional trimmers are primarily designed for trimming against the grain.

Although trimming the hair against the grain may result in each hair actually being trimmed to a uniform length, trimming with the grain results in the appearance that each hair is trimmed to a uniform length. This may be true, in part, because of the manner in which hair grows. While hair generally grows in one direction, there will be certain strands that grow with a more random orientation. When trimming against the grain, all of the strands of hair will be lifted and trimmed to substantially the same length. The hair will then settle back into its original state near the skin, with some hairs being out of alignment. These hairs will be angled in relation to the other hairs, and thus will appear to have been cut shorter or longer than the other hairs, although they have actually been cut to the same length as the other hairs. This phenomenon results in the beard having a somewhat ragged look.

In contrast, if the beard is cut with the grain, a neater and more even looking appearance can be obtained, even though each strand of hair has not actually been cut to exactly the same length. When cutting the beard with the grain, those strands of hair that are growing out of alignment (relative to the majority of the hair growth) are cut to a different than those strands that are aligned. In this manner, when the unaligned strands return to their original state, and are angled with respect to the majority of the strands in that area, all of the strands of hair will appear to have been cut to a uniform length, resulting in the desired neat and well-groomed look.

Still another object of the present invention is to provide an improved hair trimmer configured with internal components that enable the above objects to be realized.

These and other objects of the present invention are discussed or will be apparent from the following detailed description of the present invention.

BRIEF SUMMARY OF THE INVENTION

The above-listed objects are met or exceeded by the present hair trimmer, which includes a cutting surface that extends at an angle from a blade housing, and where the blade housing is rotatable with respect to the main body of the hair trimmer. Preferably, the main body of the trimmer includes an upper portion that is somewhat offset from the remainder of the main body. The interface between the blade housing and the main body of the trimmer is inclined with respect to the primary longitudinal axis of the trimmer so that when the blade housing is rotated, the cutting surface extends outwardly to predetermined angles (with respect to the primary longitudinal axis). These predetermined angles have been selected to provide maximum comfort with respect to hand and arm positioning, especially when cutting the beard with the grain of hair growth. These preselected angles also improve the visibility of the area being trimmed by placing the trimmer body and the user's hand and arm in areas that do not obstruct the view of the area being trimmed. Further improvement in visibility is obtained by the addition of a light near the cutting surface, where the light is used to illuminate the area about to be trimmed.

More specifically, the present invention provides a hair trimmer that includes a main body extending between an upper end portion and a lower end portion and further includes a front side and a rear side. The main body defines a primary longitudinal axis that extends substantially linearly between the upper end portion and the lower end portion, except for an offset portion located near the upper end portion. Alternatively, the offset portion may be omitted. A blade housing is rotatably attached to the upper end of the main body such that the blade housing is rotatable with respect to the main body. The blade housing is defined by an attached side and a free side that is located opposite to the attached side. An interface plane is defined between the main body and the blade housing. The interface plane extends at an interface angle that is oblique to the primary longitudinal axis. The present hair trimmer further includes a cutting mechanism that is seated upon the free side of the blade housing. The cutting mechanism includes a cutting surface for engaging and severing hair. As an additional feature, the present hair trimmer may be also equipped with a light for illuminating the area about to be trimmed. Furthermore, the present hair trimmer is also designed to be used, with the benefits as described, either with or without an attachment comb.

BRIEF DESCRIPTION OF THE SEVERAL VIEWS OF THE DRAWINGS

A preferred embodiment of the present invention is described herein with reference to the drawings wherein.

DETAILED DESCRIPTION OF THE INVENTION

Figure 1:
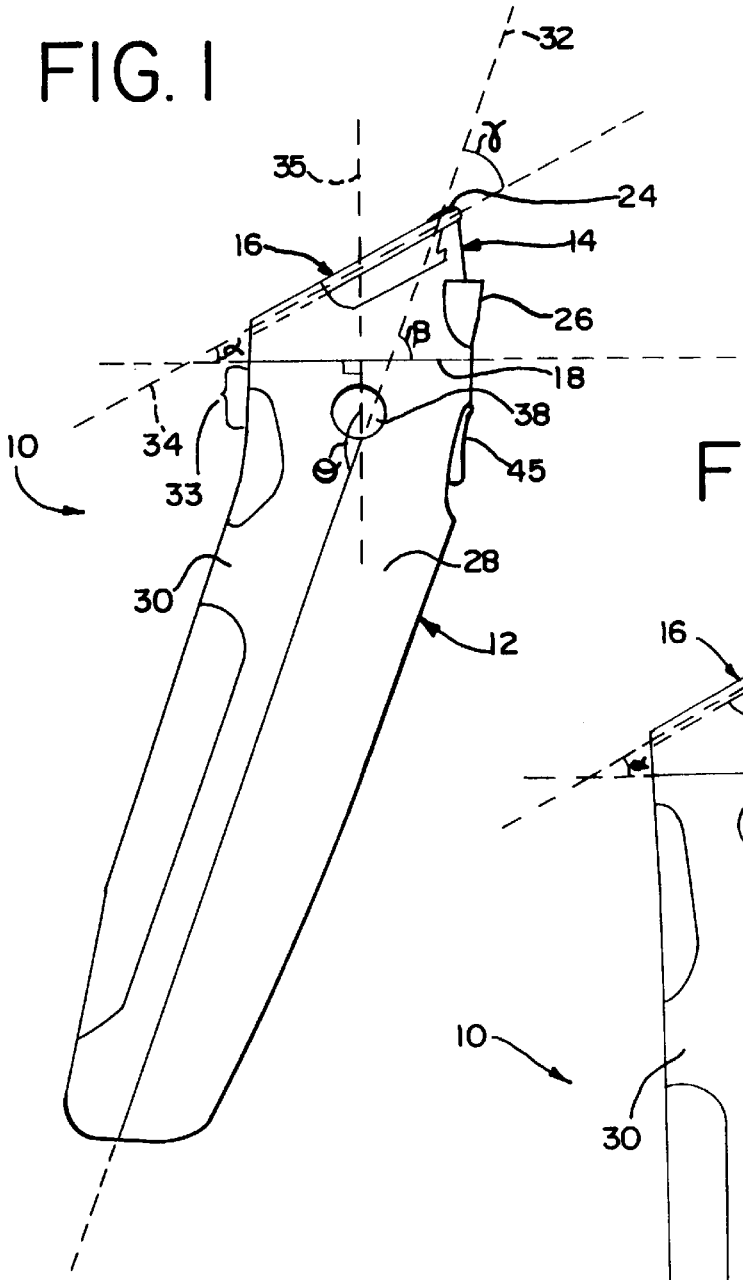
FIG. 1 is an elevational side view of an embodiment of the present hair trimmer.

Referring now to FIG. 1, an embodiment the present hair trimmer is generally designated 10, and includes three main components—a main body 12, a blade housing 14, and a cutting mechanism 16 (shown partially in hidden lines). Briefly, the blade housing 14 is configured to be rotated with respect to the main body 12, and defines an interface plane at the interface 18 between these two sections. The cutting mechanism 16 is a preferably a detachable sub-assembly of a stationary blade 20 and a reciprocating blade 22 (FIG. 7), in which the interaction of the cutting teeth of these two blades form a cutting surface 24 that can engage and sever the hair. The cutting surface 24 is defined as the area where the teeth of the reciprocating blade 22 overlap the teeth of the stationary blade 20, a configuration known to those of ordinary skill in the art. The cutting surface 24 is an area within the cutting plane 34, which is described below. An additional feature of the present invention is the inclusion of a light 26 for illuminating the area where the hair is being cut.

When reviewing the present specification, it should be understood that directional terms such as bottom, top, upwardly, downwardly, left, right, etc. have been used for convenience and clarity when referring to the drawing figures only, and are not intended to be read as limitations on the invention or on the operation of the invention.

As shown in FIG. 1, the main body 12 is essentially divided by a primary longitudinal axis 32 into a front side 28 and a rear side 30. It should be noted that when referring to the front side and the rear side, these terms are not intended to imply that the main body 12 is necessarily separated into two parts along the primary longitudinal axis 32, except where specifically described as such. Instead, these terms have been used for directional reference when viewing the drawing figures.

Figure 7:
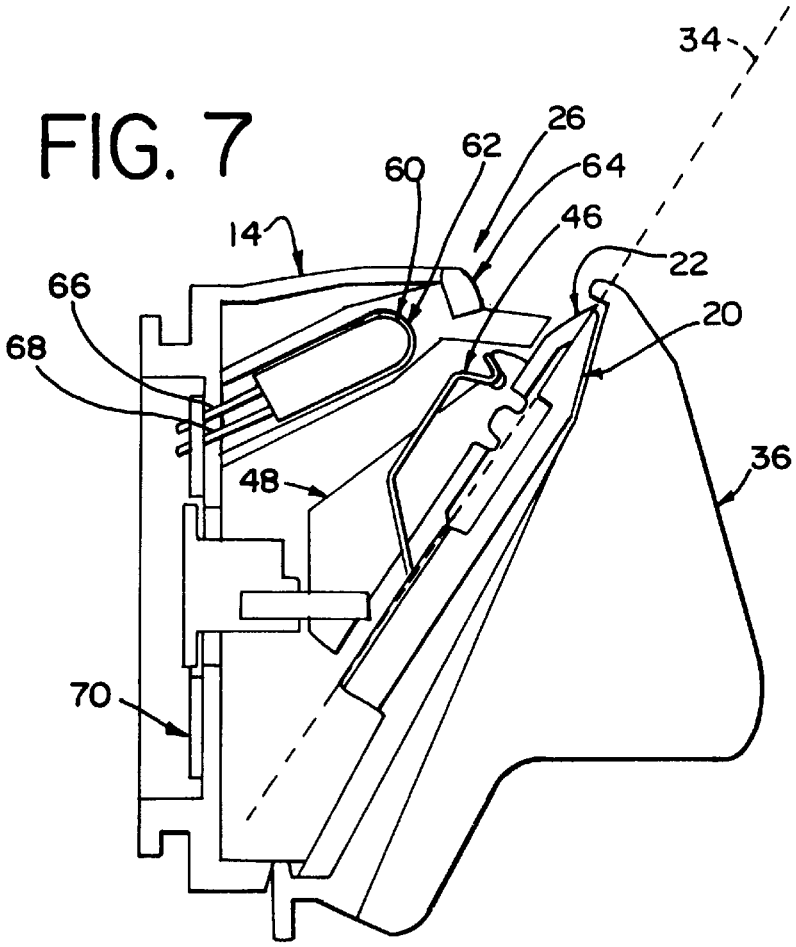
FIG. 7 is an enlarged cut-away view of the blade housing of FIG. 5.

The primary longitudinal axis 32 may also be extended into three dimensions to form a primary longitudinal plane that extends perpendicular to the two dimensional view shown in FIG. 1, where the primary longitudinal plane defined divides the front side 28 and the rear side 30. It should be noted that there is a blade angle $\alpha$ defined between the interface 18 and a cutting plane 34, which is the plane defined by the two mating surfaces of the generally parallel cooperating blades—the stationary blade 20 and the reciprocating blade 22 (FIG. 7). The blade angle $\alpha$ is preferably in the approximate range of between 15° and 45°, and is more preferably about 30°.

To better orient the blade angle $\alpha$ with respect to the main body 12, the main body may include an offset portion 33. The offset portion 33 is offset from the primary longitudinal axis 32 to extend along a secondary axis 35. An offset angle $\theta$ is defined between the primary longitudinal axis 32 and the secondary axis 35. Preferably, the offset angle $\theta$ is in the range of approximately between 150° and 170°, with approximately 160° being most preferred. It should be noted that the secondary axis 35 is preferably perpendicular to the interface 18.

Figure 1A:
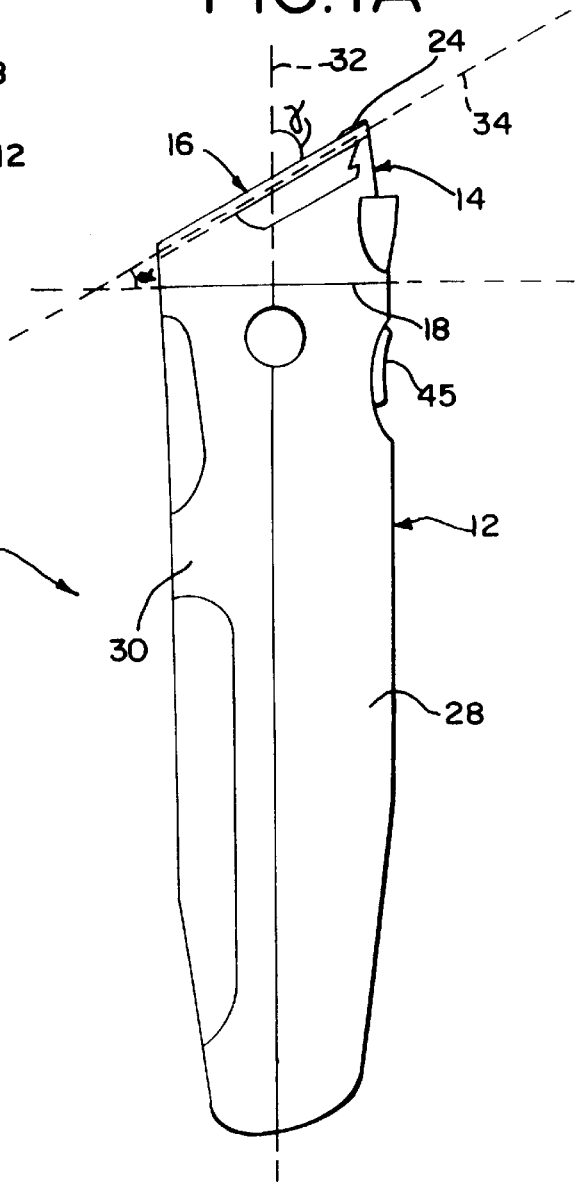
FIG. 1A is an elevational view of an alternative embodiment of the present hair trimmer
Figure 4:
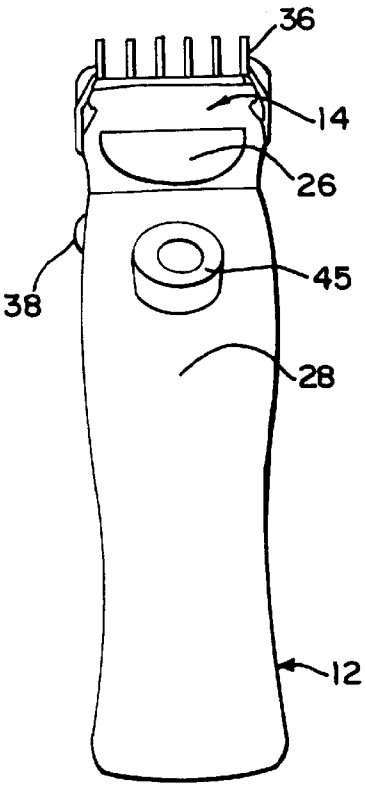
FIG. 4 is an elevational view of the front of an embodiment of the present hair trimmer, including the optional attachment comb, in which the blade housing is rotated so that the cutting surface is directed towards the front of the trimmer.

Some of the benefits of the present invention are also realized where the offset angle $\theta$ is 180°, as shown in the alternate embodiment of FIG. 1A. In this alternate embodiment, there is no offset portion, and the primary longitudinal axis 32 defined by the main body 12 is completely linear. One of the main benefits realized in this alternate embodiment is that the blade housing 14 can be rotated so that the controls, such as the switch actuator 45, can be located on either the same side as the cutting surface 24, or on the side opposite to the cutting surface. In this manner the user may select the more comfortable location of the controls for different applications.

Referring back to FIG. 1, one important feature of the present invention is that the interface 18 between the top portion of the main body 12 and the rotatable blade housing 14 is oblique with respect to the primary longitudinal axis 32. This angle, defined as interface angle $\beta$, is preferably in the approximate range of between 55° and 85°. More preferably, interface angle $\beta$ is approximately 70°. The inclusion of oblique interface angle $\beta$, in combination with the blade angle $\alpha$, enables the user to rotate the blade housing 14 to orient the cutting surface 24 between a set range of different predetermined cutting surface angles with respect to the primary longitudinal axis 32. The location of this cutting surface angle has been designated as angle $\gamma$ in FIG. 1.

Angle $\gamma$ is important because this angle governs where the main body 12 will be positioned as the trimmer 10 is being used. Normally, as the cutting surface 24 is moved about the areas of the face and neck being trimmed, the user attempts to maintain a relatively constant angle between the cutting plane 34 and the surface being trimmed. This angle is normally termed the approach angle. To maintain a constant approach angle for all of the differently oriented surfaces of the face and neck, the user must continuously adjust the inclination of the main body 12. As the cutting surface angle $\gamma$ is the relationship between the cutting plane 34 and the primary longitudinal axis 32 of the main body 12, the cutting surface angle $\gamma$ determines in which direction the main body 12 will extend when cutting different areas of the face and neck. Accordingly, the cutting surface angle $\gamma$ determines whether the main body 12 will obstruct the view of the area being trimmed, and also whether or not the trimmer 10 can be held in a position that is not awkward for the user.

Figure 3:
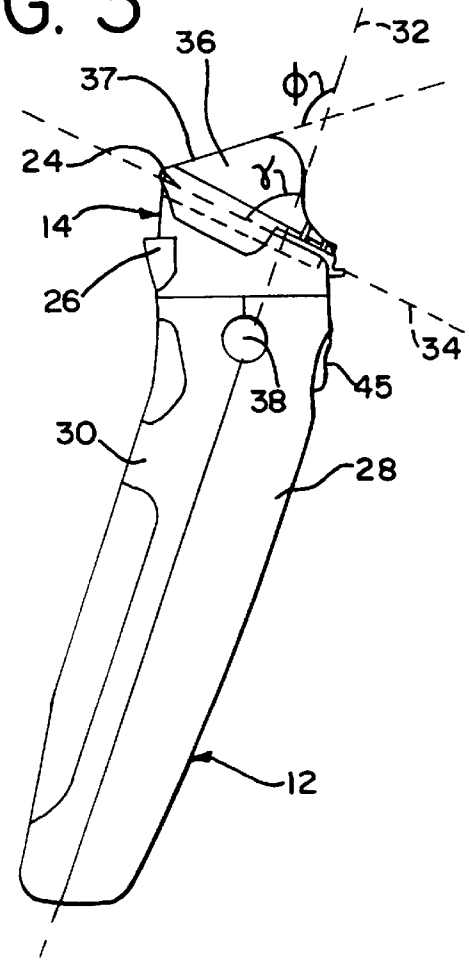
FIG. 3 is an elevational side view similar to the view of FIG. 2 (including the optional attachment comb), except that the blade housing has been rotated 180° so that the cutting surface of the blades is now directed toward the rear of the trimmer (i.e., towards the left-hand side of the figure)
Figure 2:
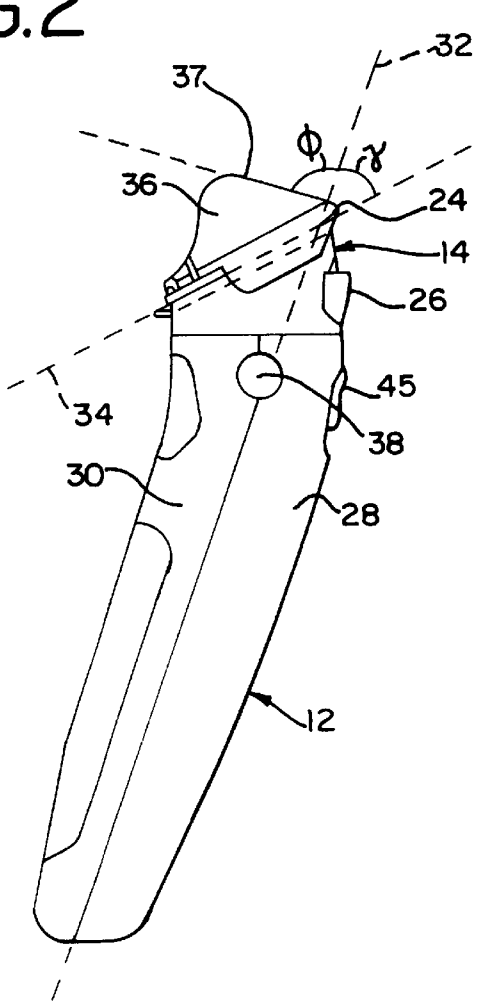
FIG. 2 is an elevational side view of an embodiment of the present hair trimmer with an attachment comb attached thereto, and where the blade housing is oriented so that the cutting surface of the blades is directed toward the front of the trimmer (i.e., towards the right-hand side of the figure)

Of particular importance are the values for the cutting surface angle $\gamma$ that result when the cutting surface 24 is aligned with either the front side 28 or the rear side 30 because these are the alignments that will most likely be used most often. Turning now to FIGS. 2 and 3, views are shown in which the cutting surface 24 is aligned with the front side 28 (FIG. 2) and the rear side 30 (FIG. 3). Incidentally, FIGS. 2 and 3 also include depictions of an attachment comb 36 with the present hair trimmer 10. Attachment combs are known to those skilled in the art for maintaining a constant approach angle, and also for keeping the cutting surface 24 at a constant distance from the skin.

Returning now to the cutting surface angle $\gamma$, it should be noted that two vastly different cutting surface angles are created when the blade housing 14 is rotated 180°. When the cutting surface 24 is aligned with the front side 28 (FIG. 2), the cutting surface angle $\gamma$ is preferably in the range of approximately between 30° and 60°, with 45° being most preferred. However, when the cutting surface 24 is aligned with the rear side 30 (FIG. 3), the cutting surface angle $\gamma$ is preferably in the range of approximately between 75° and 85°, with 80° being most preferred. These two cutting surface angles have been chosen to provide the user with two optimal cutting surface angles for cutting the differently oriented areas of the beard with the grain of hair growth (as opposed to against the grain, as conventionally taught).

When using the optional comb 36, an additional angle $\phi$ is also defined (FIGS. 2 and 3). Angle $\phi$ is the angle defined between the primary longitudinal axis 32 and a line defined by a comb periphery 37. When using comb 36, the comb periphery 37 is frequently the surface that the user slides along the skin of the area being trimmed. Accordingly, angle $\phi$ is an important angle related to the direction that the main body 12 of the trimmer 10 will extend when the comb periphery 37 is moved along the surface of the face and neck. In the embodiment shown in the Figures, angle $\phi$ is about 90° when the blade surface 24 is facing the front side 28 (FIG. 2), and about 135° when the blade surface 24 is facing the rear side 30 (FIG. 3). An approximate range for angle $\phi$ when the blade housing 14 is rotated as shown in FIG. 2 is between 80° and 120°. When the blade housing 14 is rotated as shown in FIG. 3, a suggested approximate range for angle $\phi$ is between 125° and 155°.

When cutting with the optional comb 36 along an area of the face or neck that has a certain orientation, such as the generally horizontal orientation under the chin, the user may select the large cutting surface angle $\gamma$ (and associated large angle $\phi$ of FIG. 3, which results in the main body 12 being comfortably held. However, when trimming in another area, such as near the rear of the jawline, the small cutting surface angle γ (and associated small angle ϕ) of FIG. 2 may provide a less awkward gripping position.

It should also be noted that the present hair trimmer 10 is also ergonomically designed for comfortable hand and arm positioning and improved visibility when edging or otherwise utilizing the trimmer without the optional comb 36. One example of such use is when the user rotates the blade housing 14 into the FIG. 3 position and removes the comb 36 to edge the sideburns, moustache, or beard. With the blade housing 14 rotated into this position, the angle γ between the primary longitudinal axis 32 and the cutting plane 34 is approximately 80° in the preferred embodiment. Thus, edging can be performed with the cutting plane 34 nearly horizontal and the primary longitudinal axis 32 extending essentially vertically. With the trimmer 10 in this position, the user's elbow is in a relaxed position close to the body, and the cutting surface 24 is just slightly angled upwardly with respect to the horizon to enable the user maximum visibility of the area being trimmed. A second example of a comfortable use of the present trimmer 10 when rotated to the FIG. 3 position without the comb is for trimming under the chin by stroking upwardly. The ergonomic benefits for this use are similar to those realized when edging, as described directly above.

In order to maintain the blade housing 14 at a certain rotational position with respect to the main body 12, a pivot lock 38 is provided. In a preferred embodiment, the pivot lock 38 locks the blade housing in either the FIG. 2 position or the FIG. 3 position. The pivot lock 38 can be depressed to enable the blade housing to be rotated to the opposite position than that currently held.

Figure 5:
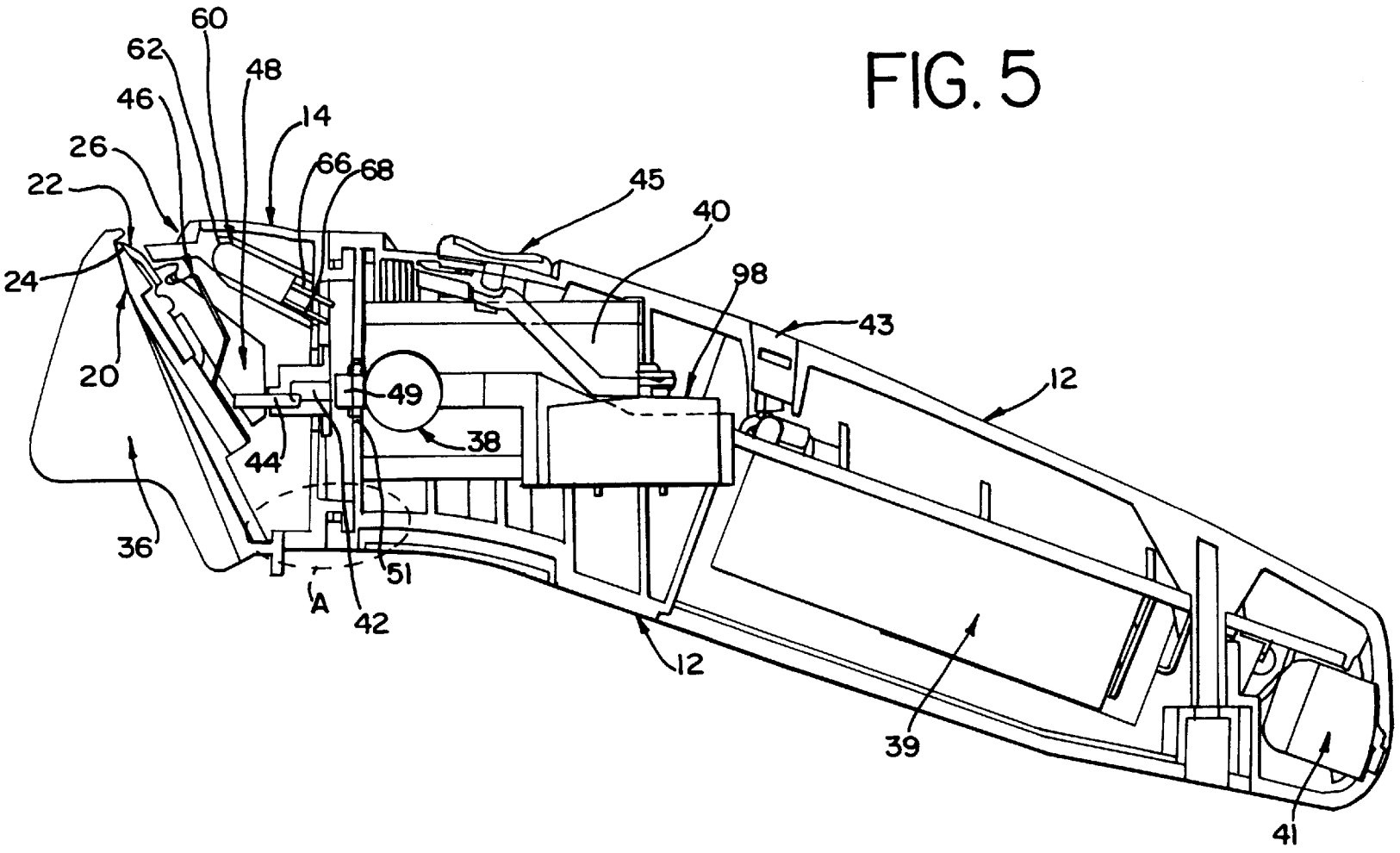
FIG. 5 is a partially cut-away view of an embodiment of the present hair trimmer.
Figure 8:
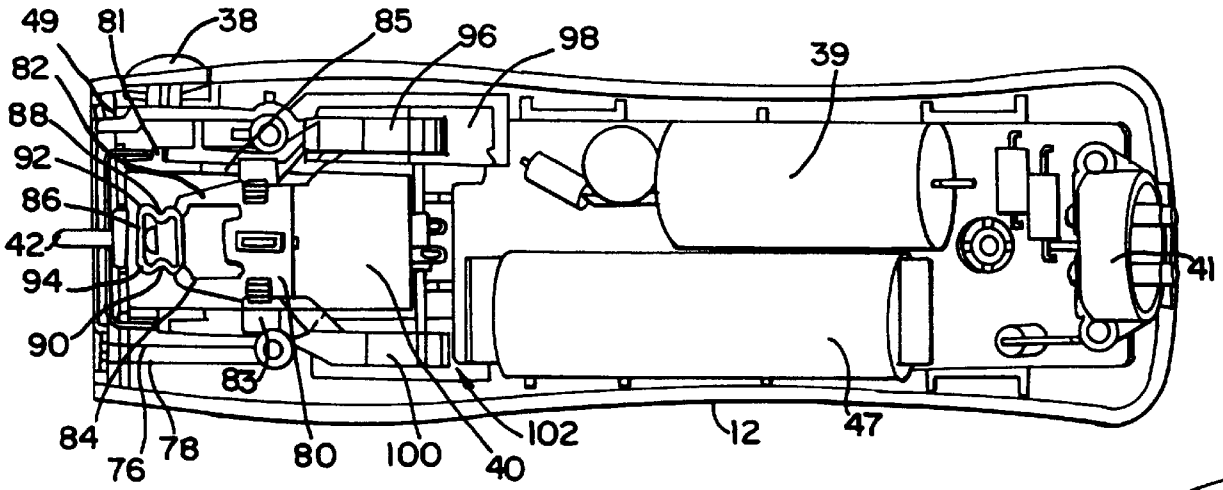
FIG. 8 is a front view of the main body of an embodiment of the present hair trimmer, with the front side portion of the main body removed to show the internal components therein.

Referring now to FIGS. 5 and 8, the pivot lock 38 is attached to a locking arm 49. This locking arm 49 is normally engaged within a detent 51 (FIG. 5 only) that is located on the blade housing 14. In the preferred embodiment, there are two detents 51 located on opposite sides of an inner circumference of the blade housing 14, where one detent locks the blade housing into the FIG. 2 position and the other detent locks the blade housing into the FIG. 3 position. To unlock the pivot lock 38 in order to rotate the blade housing 14, the pivot lock is simply pressed inwardly, and the locking arm 49 then disengages from the detent 51, which action allows rotation. The blade housing 14 may then be rotated to the opposite position, and the locking arm 49 can be engaged into the opposite detent.

With the present invention, the two optimal cutting surface angles (of FIGS. 2 and 3) are preset so that the user need not make constant adjustments to determine the proper angle. However, for those users that may desire a more customized surface angle γ for certain hard to reach areas, it is also contemplated that the rotatable blade housing 14 may also be configured to be stopped at positions other than those shown in FIGS. 2 and 3. When stopped at one of these intermediate positions, the cutting surface 24 will also be inclined at a different angular orientation than those obtained when the stopped at either the FIG. 2 position or the FIG. 3 position.

In accordance with another important aspect of the present invention, a light 26 may also be provided upon the blade housing 14. Preferably, the light 26 is located just below the cutting surface 24 so that it can illuminate the area where the hair is being cut. It should be noted that the light 26 is fixed to the blade housing 14 so that it rotates therewith. Thus, the light 26 will always be positioned below the cutting surface 24, regardless of the manner in which the blade housing 14 has been rotated with respect to the main body 12.

Turning now to FIGS. 5–9, a description of the internal components of the present hair trimmer 10 will be provided. As shown in FIG. 5, a battery 39 provides power for a motor 40. The battery 39 may be any type of suitable power source, and is preferably rechargeable through a jack 41. An LED 43 is preferably provided to indicate when the battery 39 is in need of a charge. A capacitor 47 and other electronic components associated with rechargeable power sources known to those skilled in the art are shown in FIG. 8. Power is directed from the battery 39 to the motor 40 by turning a switch actuator 45 to the "on" position.

The motor 40 is furnished with a rotating shaft 42. An eccentric cam 44 is fixed upon the rotating shaft 42. The eccentric cam 44 is seated in an elongated slot that is located in a cam follower 48 (FIG. 7). The cam follower 48 is fixed to the reciprocating blade 22. Below the reciprocating blade 22 is the stationary blade 20. The reciprocating blade 22 is biased against the stationary blade 20 by a tension spring 46. Thus, when the cam eccentric 44 turns in the slot of the cam follower 48, this eccentric rotational movement is translated into reciprocating movement that oscillates the reciprocating blade 22 with respect to the stationary blade 20. In this manner, the cutting surface 24 is defined at the point where the teeth of both blades 20 and 22 contact each other.

While one form of cutting mechanism has been shown and described, it is contemplated that other types of blade arrangements may also be used with the present hair trimmer, such as, but not limited to, simplified blade arrangements in which the cutting mechanism 16 consists primarily of a reciprocating blade and a stationary blade that affixes directly to the blade housing along with a means for guiding and applying tension to the moving blade.

Figure 6:
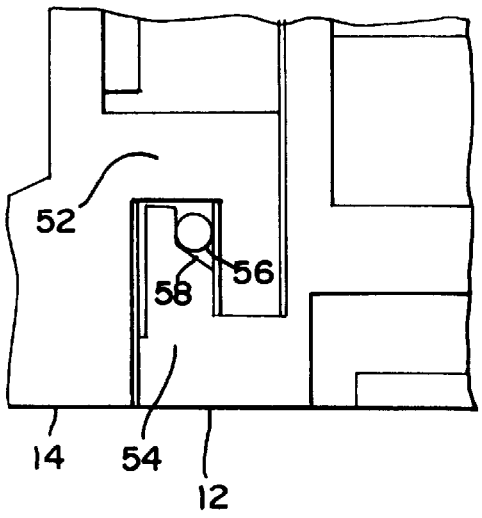
FIG. 6 is an enlarged view of the portion of FIG. 5 indicated with letter A.

Turning now to both FIG. 5 and FIG. 6, which is an enlarged view of area "A" shown in FIG. 5, a description will be provided of the manner in which the blade housing 14 may be rotated with respect to the main body 12. The blade housing 14 and the main body 12 each include complementary L-shaped flanges 52 and 54, respectively. These L-shaped flanges 52, 54 engage with each other to restrain the axial movement of the blade housing with respect to the main body 12. However, as these portions of the blade housing 14 and the main body 12 each have a circular cross-section, the blade housing is free to rotate with respect to the main body. To reduce the radial and axial "play" between these two components during relative rotation, an o-ring 56 may be seated within an o-ring groove 58 in one of the L-shaped flanges. The o-ring 56 also serves to absorb production tolerances and to seal the interface 18. During assembly of the trimmer 10, the two L-shaped flanges 52, 54 may be interlocked by placing the blade housing 14 upon either one of the sides of the main body 14 (i.e. either the front side 28 or the rear side 30) and then the remaining side of the main body 14 is fixed in place to complete the assembly.

Figure 9:
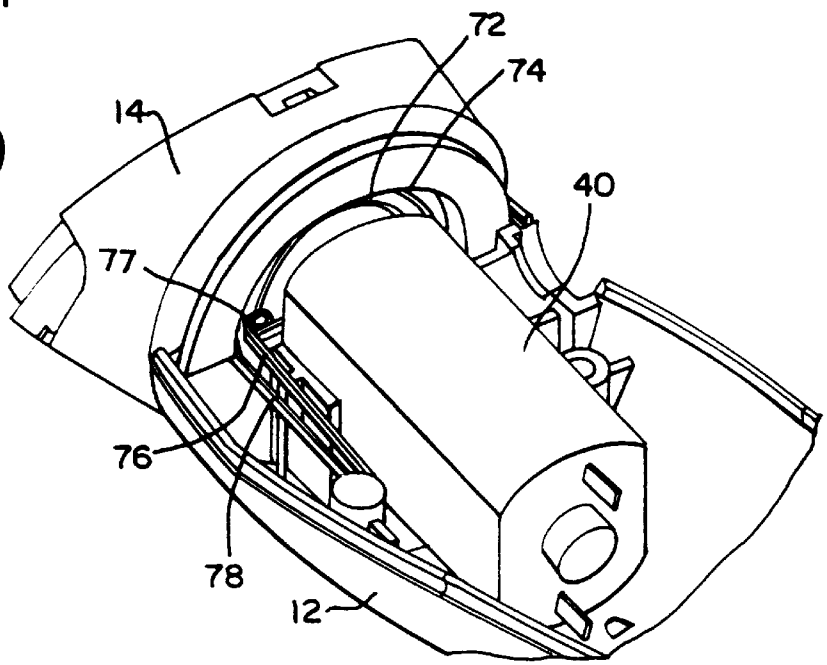
FIG. 9 is a rear view of a portion of the main body of an embodiment of the present hair trimmer with the rear side portion removed to show the internal components therein.

FIGS. 7 through 9 provide the best views on how the current is transferred from the battery 39, which is preferably located within the main body 12, to the light 26, which is located on the relatively rotatable blade housing 14. The light 26 includes a light bulb 60, which is seated within a light bulb housing area 62. To protect the light bulb 60 from damage and to better diffuse the light, a light lens 64 (also referred to as a diffuser) is provided. The light lens 64 serves to diffuse the light over a wider area to better illuminate the surface being trimmed. The light lens 64 also prevents hair and other foreign matter from collecting within the light bulb housing area 62. A pair of light bulb leads 66, 68 deliver current to the light bulb 60.

Another important aspect of the present invention is the inclusion of a slip ring 70. The slip ring 70 serves as the link for conveying power across the interface 18 between the main body 12 and the relatively rotatable blade housing 14. The slip ring 70 is fixed with respect to the blade housing 14. Each of the two light bulb leads 66, 68 are electrically connected through the slip ring 70 to a different one of a pair of concentric circles of conductive material, 72, 74. Keep in mind that the two concentric circles 72, 74 are located on the slip ring 70 on the main body side of the interface 18, while the two light bulb leads 66,68 are located on the slip ring on the blade housing side of the interface. Positioned within the main housing are two light contacts 76, 78. Light contact 76 makes an electrical connection with concentric circle 72. The tip 77 of light contact 76 continuously makes sliding contact with the concentric circle 72, even as the concentric circle (and the slip ring 70) are rotated along with the blade housing 14. The tip 77 is preferably curved so that it is slightly biased into the concentric circle 72 to maintain contact therewith. The light contact 78 is similarly slightly biased into continuous electrical contact with the other concentric circle, concentric circle 74, with the tip of light contact 78 preferably being curved in the direction opposite to the curve of tip 77 to minimize potential contact between light contact 76 and light contact 78.

The electrical circuit for the light 26 is primarily defined between the battery 39, which is preferably connected through flexible wires (not shown), or other known means for making electrical contact, with a switch 102 (FIG. 8). The switch 102 is in turn connected to the light contacts 76, 78, which are connected, respectively, to the concentric circles 72, 74 of the slip ring 70. Finally, the concentric circles 72, 74 are also electrically connected to the light leads 68, 66, where the circuit is completed through the light bulb 60.

The present hair trimmer 10 preferably includes two different operating modes: a first mode for trimming without the light and a second mode for trimming with the light. Thus, with the addition of the "off" mode, the switch actuator 45 should preferably be configured as a three-way switch (off, on without light, and on with light). Upon sliding the switch actuator 45 axially, a saddle-shaped member 80 that straddles the motor 40 is moved axially an equal distance as the switch actuator. The saddle shaped member 80 is slidably seated upon a frame 81 via two tabs 83 that ride along a corresponding pair of notches 85 in the frame 81. The notches 85 and the tabs 83 cooperate to prevent the saddle shaped member 80 from being moved too far in the axial direction within the frame 81.

As shown in FIG. 8, the saddle-shaped member 80 includes a pair of arms 82, 84 that make sliding contact with a three-way detent element 86. The three-way detent element 86 is fixed within the main body 12, and is preferably attached to the underside of the motor 40. Thus, the three-way detent 86 element serves to secure both the saddle shaped member 80 and the switch actuator 45 in one of three positions—a first position as shown in FIG. 8; a second position in which the arms 82, 84 are seated within the indented portions 88, 90; and a third position in which the arms 82, 84 are seated upon the inclined portions 92, 94.

When the switch actuator 45 is moved to the "on" position, a first arm 96 on the saddle-shaped member 80 engages a first limit switch 98 and turns on the motor 40. Upon further axial movement of the saddle-shaped member 80 to the "on with light" position, a second arm 100 engages a second limit switch 102, which switches the light bulb 60 to an illuminated state. It should be noted that the second limit switch 102 should be spaced from the first limit switch 98 so that both limit switches are not engaged with the initial movement of the switch actuator 45.

Upon movement of the switch actuator in the reverse direction, the second limit switch 102 is deactivated upon movement from the "on with light" position to the merely "on" position (without the light), and the first limit switch 98 is deactivated next when moving from the "on" position to the "off" position. It should be noted that other configurations for the three way switch are also contemplated as being within the scope of present invention.

While a particular embodiment of the present hair trimmer with a rotatable blade housing and a light has been shown and described, it will be appreciated by those skilled in the art that changes and modifications may be made thereto without departing from the invention in its broader aspects and as set forth in the following claims.

What is claimed is:

1. A hair trimmer comprising:

a main body extending between an upper end portion and a lower end portion, said main body defining a primary longitudinal plane extending substantially linearly between said upper end portion and said lower end portion to divide said main body into a front side and a rear side;

a blade housing movably attached to said upper end portion of said main body and defining an attached side and a free side opposite said attached side;

a cutting mechanism seated on said free side of said blade housing and configured to be moved therewith, said cutting mechanism including a substantially planar stationary blade and a substantially planar reciprocating blade arranged in a generally parallel relationship to define a cutting plane therebetween, said stationary blade having a stationary cutting edge and said reciprocating blade having a reciprocating cutting edge, wherein said stationary cutting edge and said reciprocating cutting edge cooperate to form a cutting surface; and wherein when said blade housing is moved so that said cutting surface is aligned with said front side, an angle defined between said cutting plane and said primary longitudinal plane is set to a first predetermined angle, and when said blade housing is moved so that said cutting surface is aligned with said rear side, the angle defined between said cutting plane and said primary longitudinal plane is set to a second predetermined angle, where said second predetermined angle is different from said first predetermined angle and said first and second predetermined angles have each been specifically selected for properly aligning the cutting surface with an area of facial hair growth when cutting hair with the grain of natural growth.

2. The hair trimmer defined in claim 1 wherein said blade housing is rotatable with respect to said main body.

3. The hair trimmer defined in claim 1 wherein said first angle is in the approximate range of between 30° and 60°.

4. The hair trimmer defined in claim 1 wherein said second angle is in the approximate range of between 75° and 85°.

5. The hair trimmer defined in claim 1 wherein said first angle is approximately 45° and said second angle is approximately 80°.

6. The hair trimmer defined in claim 1 wherein said upper end portion of said main body includes an offset portion that is offset from said primary longitudinal plane.

7. A hair trimmer comprising:

a main body extending between an upper end portion and a lower end portion and including a front side and a rear side, said main body defining a primary longitudinal axis extending substantially linearly between said upper end portion and said lower end portion;

a blade housing rotatably attached to said upper end portion of said main body such that said blade housing is rotatable with respect to said main body, said blade housing being defined by an attached side and a free side opposite said attached side, wherein an interface plane is defined between said main body and said blade housing;

a cutting mechanism seated on said free side of said blade housing, said cutting mechanism including a cutting surface for engaging and severing hair, wherein a relatively straight line defined by an outer edge of said cutting surface is substantially parallel to said interface plane throughout full rotation of said blade housing with respect to said main body; and an attachment comb removably positioned upon said free side of blade housing, wherein a comb angle is defined between an upper peripheral surface of said attachment comb and said primary longitudinal axis, and further wherein said comb angle is between approximately 80° and 155°.

8. The hair trimmer defined in claim 7 wherein an upper portion of said main body includes an offset portion that is offset from said primary longitudinal axis.

9. The hair trimmer defined in claim 7 wherein said front side and said rear side are separable portions of said main body.

10. The hair trimmer defined in claim 9 wherein said main body includes a main body flange and said blade housing includes a blade housing flange, where said main body flange and said blade housing flange interlock to secure said main body with said blade housing while still enabling relative rotation therebetween.

11. The hair trimmer defined in claim 10 wherein an o-ring is positioned between said main body and said blade housing.

12. The hair trimmer defined in claim 1 wherein said front side includes a switch thereon.

13. The hair trimmer defined in claim 7 further comprising a light positioned in the vicinity of said cutting surface for illuminating an area of hair being cut.

14. The hair trimmer defined in claim 7 further comprising a pivot lock for blocking relative rotation between said main body and said blade housing.

15. A hair trimmer comprising:

a main body extending between an upper end portion and a lower end portion and including a front side and a rear side, said main body defining a primary longitudinal axis extending substantially linearly between said upper end portion and said lower end portion;

a blade housing rotatably attached to said upper end portion of said main body such that said blade housing is rotatable with respect to said main body, said blade housing being defined by an attached side and a free side opposite said attached side;

a cutting mechanism seated on said free side of said blade housing and configured for rotation therewith, said cutting mechanism including a cutting surface for engaging and severing hair;

a light positioned on said blade housing in the vicinity of said cutting mechanism for illuminating a section of hair in position to be cut;

power source for providing power to said light and to said cutting mechanism, said power source being positioned within said main body; and a slip ring positioned near an interface between said main body and said relatively rotatable blade housing, said slip ring for conveying power from said power source to said light across said interface.

16. The hair trimmer defined in claim 15 further comprising:

a first annular conductor positioned upon said slip ring;

a second annular conductor concentric within said first annular conductor;

first and second stationary light contacts for electrically connecting said power source to said first and second annular conductors, respectively; and first and second rotatable light contacts for electrically connecting said light to said first and second annular conductors, whereby power is capable of being delivered from said power source to said light even when said blade housing is rotated with respect to said main body.

17. The hair trimmer defined in claim 15 wherein said light is positioned below said cutting surface and includes a diffuser for diffusing the illumination over a broader area.

18. A hair trimmer comprising:

a main body extending between an upper end portion and a lower end portion and including a front side and a rear side, said main body defining a primary longitudinal axis extending substantially linearly between said upper end portion and said lower end portion;

a blade housing rotatably attached to said upper end portion of said main body such that said blade housing is rotatable with respect to said main body, said blade housing being defined by an attached side and a free side opposite said attached side, wherein an interface plane is defined between said main body and said blade housing, said interface plane extending at an interface angle that is oblique to said primary longitudinal axis; and a cutting mechanism seated on said free side of said blade housing, said cutting mechanism including a cutting surface for engaging hair and for severing said hair along a relatively straight line, wherein said cutting mechanism further includes a substantially planar stationary blade and a substantially planar reciprocating blade arranged in a generally parallel relationship to define a cutting plane therebetween, where said cutting surface is defined by cooperating edges of said stationary blade and said reciprocating blade; and further wherein said cutting plane and said interface plane define an oblique blade angle therebetween.

19. The hair trimmer defined in claim 18 wherein said blade angle between said cutting plane and said interface plane is in the approximate range of between 15° and 45°.

20. The hair trimmer defined in claim 18 wherein said interface angle between said interface plane and said primary longitudinal axis is in the approximate range of between 55° and 85°.

21. The hair trimmer defined in claim 18 further comprising:

a motor with a rotatable shaft extending therefrom;

a cam eccentric attached to said shaft for eccentric rotation therewith; and a cam follower operatively connected to both said cam eccentric and to said reciprocating blade, said cam follower transforming said eccentric rotation of said cam eccentric to reciprocating motion for said reciprocating blade.

22. The hair trimmer defined in claim 18 wherein said upper end portion of said main body includes an offset portion that is offset from said primary longitudinal axis and further wherein said offset portion defines an offset axis that is substantially perpendicular to said interface plane and makes an angle of approximately 160° with respect to said primary longitudinal axis.

23. The hair trimmer defined in claim 18 wherein said blade housing is rotatable with respect to said main body about a rotational axis that is perpendicular to said interface plane.

* * * * *

UNITED STATES PATENT AND TRADEMARK OFFICE

CERTIFICATE OF CORRECTION

PATENT NO. : 5,970,616
DATED : October 26, 1999
INVENTOR(S) : Wahl et al.

It is certified that error appears in the above-identified patent and that said Letters Patent is hereby corrected as shown below:

Column 11, line 42, delete "1" and insert --7-- therefor.

Signed and Sealed this

Tenth Day of April, 2001

*Attest:*

Nicholas P. Godici

NICHOLAS P. GODICI

*Attesting Officer*

*Acting Director of the United States Patent and Trademark Office*